United States Patent [19]

Yoshida et al.

[11] Patent Number: 5,024,913

[45] Date of Patent: Jun. 18, 1991

[54] ELECTROPHOTOGRAPHIC PHOTOSENSITIVE MATERIAL

[75] Inventors: Takeshi Yoshida, Kawachinagano; Kaname Nakatani, Osaka; Toshiyuki Fukami, Sakai; Nariaki Tanaka, Kishiwada, all of Japan

[73] Assignee: Mita Industrial Co., Ltd., Osaka, Japan

[21] Appl. No.: 441,263

[22] Filed: Nov. 27, 1989

[30] Foreign Application Priority Data

Nov. 30, 1988 [JP] Japan ..... 63-302657
Nov. 30, 1988 [JP] Japan ..... 63-302659

[51] Int. Cl.[5] ..... G03G 15/04; G03G 5/00
[52] U.S. Cl. ..... 430/67; 430/132
[58] Field of Search ..... 430/67

[56] References Cited

U.S. PATENT DOCUMENTS 4,031,206 12/1986 Mabuchi et al. ..... 428/424.6 X
4,798,879 1/1989 Hannah et al. ..... 528/45

FOREIGN PATENT DOCUMENTS 0047835 4/1978 Japan ..... 430/67

*Primary Examiner*—Marion E. McCamish
*Assistant Examiner*—S. Crossan
*Attorney, Agent, or Firm*—Beveridge, DeGrandi & Weilacher

[57] ABSTRACT

The invention presents an electrophotographic photosensitive material possessing a surface layer excellent in wear resistance, without adversely affecting the photosensitive characteristics, wherein a photosensitive layer and a surface protective layer containing a thermoset silicone resin are laminated in this order on a substrate surface, and the silicone resin of the surface protective layer is hardened by a hardening catalyst mainly composed of a compound of the general formula (I) or an acid salt thereof which is selected from the group consisting of: a phenol salt, an octylic acid salt, a p-toluenesulfonic acid salt and a formic acid salt Formula (I)

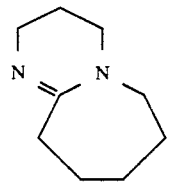

15 Claims, No Drawings

ELECTROPHOTOGRAPHIC PHOTOSENSITIVE MATERIAL

BACKGROUND OF THE INVENTION

The present invention relates to an electrophotographic photosensitive material, and more particularly to an electrophotographic photosensitive material possessing a surface protective layer.

In an image forming apparatus such as copier utilizing the so-called Carlson process, an electrophotographic photosensitive material forming a photosensitive layer on a conductive substrate is used.

Since the electrophotographic photosensitive material is repeatedly exposed to electrical, optical and mechanical impacts in the image forming process, a surface protective layer containing binding resin is laminated on the photosensitive layer for the purpose of enhancing the durability to these impacts.

As the binding resin, a thermoset silicone resin is mainly used for improving the hardness of the surface protective layer.

The thermoset silicone resin may be cured by heating only, depending on the conditions, without using catalyst, but a catalyst is generally used for finishing the hardening reaction smoothly and uniformly.

As the catalyst for hardening the thermoset silicone resin, inorganic acids, organic acids, alkalis such as amines, and various materials are generally used, but the following performances are required for the catalyst for hardening the thermoset silicone resin used in the surface protective layer.

(1) Capable of forming a surface protective layer excellent in mechanical strength by hardening.

(2) Not to adversely affect the sensitivity and other properties of electrophotographic photosensitive material.

As the materials having these performances to a certain extent, organic tin compounds such as dibutyl tin dilaurate (DTL) and dibutyl tin dioctate (DTO) have been proposed (see the Japanese Laid-Open Patent No. 60-4945).

However, the surface protective layer hardened by using such organic tin compound is not sufficient in the wear resistance, or the initial sensitivity of the electrophotographic photosensitive material is not sufficient, or the surface potential of the photosensitive material is lowered when exposed repeatedly, and the catalyst remaining on the surface protective layer sometimes adversely affected the photosensitive characteristics.

SUMMARY OF THE INVENTION

It is hence a primary object of the invention to present an electrophotographic photosensitive material possessing a surface protective layer excellent in wear resistance, without adversely affecting the photosensitive characteristics. It is another object of the invention to present an electrophotographic photosensitive material possessing a surface protective layer improved in the gas barrier property, brittleness to sliding friction and others.

According to the invention, a photosensitive layer and a surface protective layer containing a thermoset silicone resin are laminated in this order on a conductive substrate surface, and the silicone resin of the surface protective layer is hardened by a hardening catalyst mainly composed of 1,8 diaza-bicyclo[5,4,0]undecene-7 (hereinafter, may be referred to as "DBU") of the general formula (I), or acid salts thereof, which are selected from the group consisting of: a phenol salt, an octylic acid salt, a p-toluenesulfonic acid salt, and a formic acid salt.

(I)

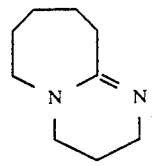

DBU and acid salts thereof, such as phenol salt, an octylic acid salt, a p-toluenesulfonic acid salt or a formic acid salt have a portion acting the same as tertiary amine about the nitrogen atom in their heterocyclic ring.

Accordingly, when the above compounds are used as a hardening catalysts, as compared with the case of using the conventional organic tin compounds as hardening catalyst, it is possible to form a surface protective layer excellent in wear resistance. Besides, the electrophotographic photosensitive material possessing the above protective layer is excellent in the initial sensitivity and is smaller in the drop of surface potential after repeated exposure.

The reason of such manifest effects presented by the above compounds as hardening catalysts is not clear at the present. As known well, much is unelucidated about the combination of thermoset resin material and hardening catalyst, relation of cured resin and properties, and effects of catalyst left over in the cured resin. Therefore, that the catalyst of the invention having the above composition has brought about particularly notable effects as the hardening catalyst of the surface layer of an electrophotographic photosensitive material was utterly beyond expectation by those skilled in the art, and the explanation of the reason is completely impossible at the present.

In this electrophotographic photosensitive material, the surface protective layer may contain polyvinyl acetate with the mean degree of polymerization of 2000 or less at a rate of 0.1 to 30 parts by weight to 100 parts by weight of solid content of the thermoset silicone resin. In this case, the surface protective layer is powerfully resistant to sliding friction, high in surface hardness, and excellent in gas barrier property and transparency.

DETAILED DESCRIPTION OF THE INVENTION

The rate of use of the hardening catalyst to the thermoset silicone resin is not particularly defined, but it is preferably in a range of 0.1 to 20 wt. % of the entire solid content of the thermoset resin, particularly in a range of 0.5 to 10 wt. %. This is because, if less than 0.1 wt. %, the thermoset resin in the surface layer cannot be hardened sufficiently and the surface layer excellent in wear resistance cannot be formed, and if more than 20 wt. %, the sensitivity of the electrophotographic photosensitive material is insufficient, and the surface potential of the photosensitive material is lowered if exposed repeatedly, and adverse effects are exerted on the performance of electrophotographic photosensitive material.

Meanwhile, such hardening catalyst may be used, if necessary, together with known hardening aids or the like.

Preferred examples of the thermoset resin may include organoalkoxy silane such as tetraalkoxy silane, trialkoxy silane and dialkoxy dialkyl silane; and organohalogen silane such as trichloralkyl silane and dichlordialkyl silane, and their independent hydrolysates (so-called organopolysiloxane) or mixture of two or more types, or their initial polymerization reaction products. As the alkoxy group or alkyl group of silane compound, lower groups with 1 to 4 carbon atoms, such as methoxy group, ethoxy group, methyl and ethyl are preferable.

The surface protective layer is formed by applying a silicone resin paint containing thermoset silicone resin on a photosensitive layer, and hardening by using the above catalyst. At this time, the pH of the silicon resin paint may be preferably adjusted in a range of 5.0 to 6.5. If the pH exceeds 6.5, the stability of silanol contained in the silicone resin paint is inferior, or if the pH is less than 5.0, it is difficult to obtain an electrophotographic photosensitive material excellent in repeated charging characteristic and wear resistance. Therefore, for the adjustment of pH, various organic acids and/or inorganic acids are added.

The thermoset silicone resin may be used either alone or in mixture with other thermoset resin (for example, polyurethane, epoxy resin, etc.), or thermoplastic resin (such as ethyl cellulose, polyamide, polypyridine, polyvinyl acetate). In particular, it is preferred to contain polyvinyl acetate with a mean degree of polymerization of 2000 or less in an amount of 0.1 to 30 parts by weight of 100 parts by weight for the solid content of the thermoset silicone resin. As a result, the surface protective layer becomes resistant to sliding abrasion, high in surface hardness and excellent in tranparency. Also becoming excellent in gas barrier property, it is possible to prevent destruction of the photosensitive layer by the ozone formed in corona discharge.

The surface protective layer adding polyvinyl acetate to thermoset silicone resin was already disclosed in the Japanese Laid-Open Patent No. 63-18354, but the composition of adding polyvinyl acetate with mean degree of polymerization of 2000 or less which does not act as binding resin alone, by 0.1 to 30 parts by weight to 100 parts by weight of solid matter of the thermoset silicone resin has been discovered by the present inventors after repeated studies, and it is a completely novel composition.

Incidentally, when the mean degree of polymerization of the polyvinyl acetate used in this composition exceeds 2000, the surface hardness and transparency of the surface protective layer are lowered, and adverse effects are applied to the sensitivity characteristics of the electrophotographic photosensitive material, which is not preferable.

Other thermoplastic resins or thermoset resins that come with thermoset silicone resin may be used in accordance with this invention, for example, curing acrylic resin; alkyd resin; unsaturated polyester resin; diallylphthalate resin; phenol resin; urea resin; benzoguanamine resin; melamine resin; styrene polymer; acrylic polymer; styreneacrylic copolymer; polyethylene, ethylene-vinyl acetate copolymer, chlorinated polyethylene, polypropylene, ionomer, and other olefin polymers; polyvinyl chloride; vinyl chloride-vinyl acetate copolymer; polyvinyl acetate; saturated polyester; polyamide; thermoplastic polyurethane resin; polycarbonate; polyallylate; polysulfone; ketone resin; polyvinyl butyral resin; and polyether resin.

The surface protective layer may contain various additives, for example, terphenyl, halonaphthquinones, acenaphthylene and other known intensifiers; 9-(N,N-diphenylhydrazino)fluorene, 9-carbozolylimonofluorene and other fluorene compounds; conductivity additives; amine, phenol and other oxidation inhibitors, benzophenon and other ultraviolet absorbents, and similar deterioration inhibitors; and plasticizers.

The film thickness of the surface protective layer should be preferably 0.1 to 10 $\mu$m, or particularly in a range of 2 to 5 $\mu$m.

The photosensitive material of the invention may be formed in the same manner as in the prior art by using the same materials as in the prior art, as for the conductive substrate and photosensitive layer, except for the surface protective layer in accordance with the invention is used.

The conductive substrate is first described. The conductive substrate is formed in sheet, drum or other proper shape depending on the mechanism and structure of the image forming apparatus in which the electrophotographic photosensitive material is incorporated. The conductive substrate may be entirely made of metal or other conductive material, or the substrate may be made of a structural material not possessing conductivity, and conductivity may be applied on the surface.

Conductive materials used in the conductive substrate in the former structure may include, among other, metal materials such as alumite-treated or untreated aluminum, copper, tin, platinum, gold, silver, vanadium, molybdenum, chromium, cadmium, titanium, nickel, palladium, indium, stainless steel and brass.

On the other hand, as the latter structure, on the surface of synthetic resin substrate or glass substrate, a thin film made of the metals presented above, or aluminum iodide, tin oxide, indium oxide or the like may be laminated by known film forming methods such as vacuum deposition or wet process plating, or the film of metal materials or the like is laminated on the surface of synthetic resin forming substrate or glass substrate, or a substance for applying conductivity is injected into the surface of synthetic resin forming substrate or glass substrate.

Meanwhile, the conductive substrate may be treated, if required, with surface treating agent such as silane coupling agent and titanium coupling agent so as to enhance the adhesion with the photosensitive layer.

The photosensitive layer formed on the conductive substrate is described below.

As the photosensitive layer, semiconductor material, organic material, or their compound material may be used in the following composition.

(1) A photosensitive layer of a single layer type made of semiconductor material.

(2) An organic photosensitive layer of single layer type containing an electric charge generating material and charge conveying material within a binding resin.

(3) An organic photosensitive layer of laminate type, consisting of an electric charge generation layer containing an electric charge generating material within a binding resin, and an electric charge conveying layer containing an electric charge conveying material within the binding resin.

(4) A photosensitive layer of compound type laminating an electric charge generating layer made of semiconductor material and the organic electric charge conveying layer.

Examples of semiconductor material used as the electric charge generating layer in the compound type photosensitive layer and also capable of forming photosensitive layer alone include, aside from a-Se stated above, a-$As_2Se_3$, a-SeAsTe and other amorphous chalcogen, and amorphous silicon (a-Si). The photosensitive layer or electric charge generating layer made of such semiconductor material may be formed by known film forming methods such as vacuum deposition and glow discharge decomposition method.

Organic or inorganic electric charge generating materials used in the electric charge generating layer in single layer type or laminate type organic photosensitive layer may include, for example, powder of the semiconductor materials presented above; Group II-VI fine crystals such as ZnO and CdS; pyrilium salt; azo compound; bis azo compound; phthalocyanine compound; ansanthrone compound; perylene compound, indigo compound, triphenylmethane compound; surene compound; toluidine compound; pyrazoline compound; quinacridone compound; and pyrolopyrol compound. Among the presented compounds; aluminum phthalocyanine, copper phthalocyanine, metal-free phthalocyanine, titanyl phthalocyanine, and others possessing $\alpha$, $\beta$, $\gamma$ and other crystal types belonging of phthalocyanine compounds may be preferably used, and in particular, metal-free phthalocyanine and/or titanyl phthalocyanine may be preferably used. Meanwhile, these electric charge generating materials may be used either alone or in combination of plural types.

Practical examples of electric charge conveying material contained in the electric charge conveying layer in the single layer type or laminate type organic photosensitive layer or compound type photosensitive layer include tetracyanoethylen; 2,4,7-trinitro-9-fluorenone and other fluorenone compounds; dinitroanthracene and other nitro compounds; succinic anhydride; maleic anhydride; dibromomaleic anhydride; triphenyl methane compound; 2,5-di(4-dimethyl aminophenyl)-1,3,4-oxadiazol and other oxadiazol compounds; 9-(4-diethylaminostyryl)anthracene and other styryl compounds; poly-N-vinyl carbazole and other carbazole compounds; 1-phenyl-3-(p-dimethyl aminophynyl)-pyrazoline and other pyrazoline compounds; 4,4',4''-tris(N,N-diphenylamino) triphenylamine and other amine derivatives; 1,1-bis(4-diethylaminophenyl)-4,4-diphenyl-1,3-butadiene and other conjugate unsaturated compounds; 4-(N,N-diethylamino)benzaldehyde-N,N-diphenyl hydrazone and other hydrazone compounds; indole compound, oxazole compound, isooxazole compound, thiazole compound, thiadiazole compound, imidazole compound, pyrazole compounds, pyrazoline compounds, triazole compounds, and other nitrogen-containing cyclic compounds; and condensed polycyclic compounds. These electric charge conveying materials may be used either alone or in combination of plural types. Among the listed electric charge conveying materials, the macromolecular materials having photoconductivity such as poly-N-vinyl carbazole may be used also as the binding resin.

The layers such as the single layer type or laminate type organic photosensitive layer, the electric charge conveying layer in compound type photosensitive layer, and surface protective layer may contain various additives, such as terphenyl, haronaphthoquinone, acenaphthylene and other known intensifiers, 9-(N,N-diphenyl hydrazino)fluorene, 9-carbozolyliminofluorene and other fluorene compounds, oxidation inhibitor, ultraviolet absorber and other deterioration inhibitor, and plasticizer.

In the organic photosensitive layer of single layer type, the content of the electric charge generating material in 100 parts by weight of binding resin is in a range of 2 to 20 parts by weight, in particular, 3 to 15 parts by weight, while the content of the electric charge conveying material in 100 parts by weight of binding resin is 40 to 200 parts by weight, in particular 50 to 100 parts by weight. If the content of the electric charge generating material is less than 2 parts by weight or the electric charge conveying material is less than 40 parts by weight, the sensitivity of the photosensitive material may not be sufficient, or the residual potential may be too large. If the electric charge generating material exceeds 20 parts by weight or the electric charge conveying material exceeds 200 parts by weight, the resistance to wear of the photosensitive material may not be sufficient.

The single layer type photosensitive material may be formed in a proper thickness, and usually it is desired to be formed in a range of 10 to 50 $\mu$m, or particularly in a range of 15 to 25 $\mu$m.

On the other hand, of the layers for composing the laminate type organic photosensitive layer, the content of the electric charge generating material in 100 parts by weight of the binding resin in the electric charge generating layer is preferably in a range of 5 to 500 parts by weight, or more preferably 10 to 250 parts by weight. If the content of the electric charge generating material is less than 5 parts by weight, the electric charge generating capacity is too small, and if it exceeds 500 parts by weight, the adhesion with the adjacent layer or substrate is lowered.

The film thickness of the electric charge generating layer is preferably 0.01 to 3 $\mu$m, or more preferably 0.1 to 2 $\mu$m.

Of the layers for composing the laminate type organic photosensitive layer and compound type photosensitive layer, the content of the electric charge conveying material in 100 parts by weight of the binding resin in the electric charge conveying layer is preferably 10 to 500 parts by weight, or more preferably 25 to 200 parts by weight. If the content of the electric charge conveying material is less than 10 parts by weight, the electric charge conveying capacity is not enough, or if it exceeds 500 parts by weight, the mechanical strength of the electric charge conveying layer is lowered.

The film thickness of the electric charge conveying layer is preferably 2 to 100 $\mu$m, or more preferably 5 to 30 $\mu$m.

Of the single layer type or laminate type organic photosensitive layer, and compound type photosensitive layer, the organic layers such as electric charge conveying layer and surface protective layer may be laminated by preparing a coating solution for each layer containing the ingredients stated above, applying these coating solutions sequentially on the conductive substrate in each layer so as to form the layer compositions as stated above, and drying or curing.

In preparation of the above coating solutions, various solvents may be used depending on the type of the binding resin and others to be used. Such examples of solvent may include, among others, n-hexane, octane, cyclohexane and other aliphatic hydrocarbons; benzene, xylene, toluene and other aromatic hydrocarbones; dichloromethane, carbon tetrachloride, chlorobenzene, methylene chloride and other halogenated hydrocarbons; methyl alcohol, ethyl alcohol, isopropyl alcohol, allyl alcohol, cyclopentanol, benzyl alcohol, furfuryl alcohol, diacetone alcohol, and other alcohols; dimethyl ether, diethyl ether, tetrahydrofurane, ethyleneglycol dimethylether, ethylene glycol diethylether, diethyleneglycol dimethylether, and other ethers; acetone, methylethylketone, methylisobutylketone, cyclohexane and other ketones; ethyl acetate, methyl acetate, and other esters; dimethyl formamide; and dimethylsulfoxide, and these are used either alone or in combination of two or more types. Besides, when preparing such coating solutions, in order to enhance the dispersing ability or coating performance, surface active agent or leveling agent may be used.

The coating solutions may be prepared by conventional methods, such as mixer, ball mill, paint shaker, sandmill, atriter, and ultrasonic dispersion machine.

EXAMPLES

The invention is described in further details by reference to the following examples.

EXAMPLE 1

An electric charge conveying coating solution was prepared by using 100 parts by weight of polyallylate (tradename U-100 of Unitika Ltd.), 100 parts by weight of 4-(N,N-diethylamino) benzaldehyde-N,N-diphenyl hydrazone, and 900 parts by weight of methylene chloride ($CH_2Cl_2$). This coating solution was applied on an aluminum tube of 78 mm in outside diameter by 340 mm in length, and was heated and dried for 30 minutes at 100° C., and an electric charge conveying layer of film thickness of 20 μm was formed.

On this electric charge conveying layer was applied an electric charge generating layer coating solution composed of 80 parts by weight of 2,7-dibromoansanthrone (prepared by ICI), 20 parts by weight of metal-free phthalocyanine (BASF), 50 parts by weight of polyvinyl acetate (Y5-N of Nippon Gosei Kagaku), and 2000 parts by weight of diacetone alcohol, and by drying in the same condition as above, an electric charge generating layer of film thickness of 0.5 μm was formed.

Mixing 57.4 parts by weight of 0.02N hydrochloric acid and 36 parts by weight of isopropylalcohol, the obtained mixed solution was stirred while keeping the solution temperature at 20° to 25° C., and 144.7 parts by weight of methyltrimethoxysilane was gradually dropped, and by letting stand for 1 hour at room temperature, 238.1 parts by weight of reaction solution containing 100 parts by weight of hydrolysis composition of methyltrimethoxysilane was obtained.

To this reaction solution, 3.3 parts by weight of bisphenol A epoxy resin (Epicoat 827 of Shell, epoxy equivalent 180 to 190), 0.3 part by weight of DBU, 19.6 parts by weight of acetic acid, 32.7 parts by weight of n-butylacetate, 16.4 parts by weight of carbitolacetate, 16.4 parts by weight of xylene, 0.3 part by weight of silicone surface active agent, and 50 parts by weight of antimony doped tin oxide fine powder as conductivity additive (Sumitomo Cement) were added, and a coating solution for surface protective layer (pH 5.7) was prepared. This surface protective layer coating solution was applied on the electric charge generating layer, and was heated and hardened for 1 hour at 110° C., and a silicone resin surface protective layer of 2.5 μm in film thickness was formed, and a drum type electrophotographic photosensitive material having a laminate type photosensitive layer was fabricated.

EXAMPLE 2

Instead of 0.3 part by weight of DBU, a coating solution for surface protective layer (pH 5.3) containing 1 part by weight of phenol salt of DBU ("U-Cat SA 1" manufactured by San Apro) was used, and an electrophotographic photosensitive material was fabricated in the same manner as in Example 1.

EXAMPLE 3

Instead of 3.3 parts by weight of bisphenol A epoxy resin, a coating solution for surface protective layer (pH 5.6) containing 5.0 parts by weight of polyglycol epoxy resin (Denacol EX-314 of Nagase Sangyo, epoxy equivalent 150) was used, and an electrophotographic photosensitive material was fabricated in the same manner as in Example 1.

COMPARATIVE EXAMPLE 1

Instead of 0.3 part by weight of DBU, a coating solution for surface protective layer (pH 5.8) containing 1 part by weight of dibutyl tin dilaurate was used, and an electrophotographic photosensitive material was fabricated in the same manner as in Example 1.

COMPARATIVE EXAMPLE 2

Instead of 0.3 part by weight of DBU, a coating solution for surface protective layer (pH 6.7) containing 1 part by weight of triethylamine was used, and an electrophotographic photosensitive material was fabricated in the same manner as in Example 1.

COMPARATIVE EXAMPLE 3

Instead of 0.3 part by weight of DBU, a coating solution for surface protective layer (pH 6.1) containing 1 part by weight of sodium acetate was used, and an electrophotographic photosensitive material was fabricated in the same manner as in Example 1.

The following tests were conducted on the electrophotographic photosensitive materials prepared in Examples 1 to 3 and Comparative Examples 1 to 3.

EVALUATION TESTS

Surface Potential Measurement

Each electrophotographic photosensitive material was set in an electrostatic reproduction testing apparatus (Gentech Cynthia 30M of Gentech), and the surface was positively charged, and the surface potential $V_1$ s.p. (V) was measured.

Half-life Exposure, Residual Potential Measurement

The electrophotographic photosensitive material in the charged state was exposed by using a halogen lamp as the exposure source of the electrostatic reproduction testing apparatus at the exposure intensity of 0.92 $mW/cm^2$ and exposure time of 60 msec, and the time until the surface potential V s.p. became ½ was determined, and the half-life exposure $E_{\frac{1}{2}}$ ($\mu J/cm^2$) was calculated.

The surface potential from start of exposure time till lapse of 0.4 second was measured as the residual potential V r.p. (V).

Measurement of Surface Potential Change After Repeated Exposures

The electrophotographic photosensitive material was set in a copier (DC-111 of Mita), and 500 copies were reproduced, and the surface potential was measured as the surface potential $V_2$ s.p. (V) after repeated exposures.

The difference of $V_1$ s.p. and $V_2$ s.p. was calculated as the surface potential change $\Delta V$ (V).

Wear Resistance Test

Each electrophotographic photosensitive material was set in a drum polishing testing apparatus (Mita), and a polishing test paper (Imperial Lapping Film of Sumitomo 3M, with the surface coated with aluminum oxide powder of particle size of 12 μm) was fitted to the polishing test paper mounting ring rotating one revolution while the photosensitive materials turns 1000 times installed in this drum polishing testing machine, and while pressing this polishing test paper to the surface of photosensitive material at a line pressure of 10 g/mm, the photosensitive material was rotated 400 revolutions, and the wear (μm) was measured.

The above results are shown in Table 1.

TABLE 1

| | $V_1$ s.p. (V) | $V_2$ s.p. (V) | $-\Delta V$ (V) | V r.p. (V) | $E_{\frac{1}{2}}$ (μJ/cm$^2$) | Wear (mm) |
|---|---|---|---|---|---|---|
| Example 1 | 748 | 719 | −29 | 132 | 19.4 | 0.6 |
| Example 2 | 760 | 733 | −27 | 140 | 19.8 | 0.7 |
| Example 3 | 746 | 714 | −32 | 138 | 20.1 | 0.7 |
| Comparative Example 1 | 736 | 694 | −42 | 172 | 27.3 | 1.8 |
| Comparative Example 2 | 741 | 680 | −61 | 157 | 23.5 | 1.5 |
| Comparative Example 3 | 723 | 658 | −65 | 158 | 24.2 | 1.9 |

As clear from Table 1, the electrophotographic photosensitive materials fabricated in Examples 1 to 3 were, as compared with Comparative Examples 1 to 3, lower in the residual potential, smaller in half-life exposure, smaller in lowering of the surface potential after repeated exposures, and were found to be excellent in photosensitive characteristics. The electrophotographic photosensitive materials fabricated in these Examples were also found to be excellent in the wear resistance of the surface protective layer as the surface layer.

In Examples 1 to 3, meanwhile, the hardening rate of the surface protective layer was not influenced by the humidity in the atmosphere and other conditions, and the efficiency of hardening was excellent, and the storage stability of the coating solutions for surface protective layer was also superb, and the surface protective layer after hardening was excellent in transparency and was free from cracks.

EXAMPLES 4 TO 8, COMPARATIVE EXAMPLES 4 TO 7

A coating solution for electric charge conveying layer was prepared by using 100 parts by weight of polyallylate (U-100 of Unitika), 100 parts by weight of 4-(N,N-diethylamino) benzaldehyde-N,N-diphenyl hydrazine, and 900 parts by weight of methylene chloride ($CH_2Cl_2$), and this coating solution was applied on an aluminum tube of 78 mm in outside diameter by 340 mm in length, and was heated for 30 minutes at 100° C., and an electric charge conveying layer of film thickness of 20 μm was formed.

On this electric charge conveying layer was applied a coating solution for electric charge generating layer comprising 80 parts by weight of 2,7-dibromoansanthrone (ICI), 20 parts by weight of metal-free phthalocyanine (BASF), 50 parts by weight of polyvinyl acetate (Y5-N of Nippon Gosei Kagaku), and 2000 parts by weight of diacetone alcohol, and it was dried in the same condition as above, and an electric charge generating layer of film thickness of 0.5 μm was formed.

Mixing 57.4 parts by weight of 0.02N hydrochloric acid and 36 parts by weight of isopropyl alcohol, the obtained mixed solution was stirred while keeping the temperature at 20° to 25° C., and 80 parts by weight of methyl trimethoxysilane and 20 parts by weight of glysidexypropyl trimethoxysilane were gradually dropped, and by letting stand at room temperature for 1 hour, a silane hydrolysis solution was obtained.

To this silane hydrolysis solution, polyvinyl acetate of the mean degree of polymerization and content as specified in Table 2, 1.0 parts by weight of DBU as hardener, 50 parts by weight of antimony doped tin oxide fine powder (Sumitomo Cement) as conductivity additive, and 0.3 par by weight of silicone surface active agent were added to prepare a coating solution for surface protective layer, and this coating solution for surface protective layer (pH 5.7) was applied on the electric charge generating layer, and was heated for 1 hour at 110° C. and hardened, and a surface protective layer of silicone resin with film thickness of 2.5 μm was formed, and a drum type electrophotographic photosensitive material having a laminate type photosensitive layer was fabricated.

Meanwhile, the polyvinyl acetate was prepared by diluting vinyl acetate monomer in methyl alcohol, and using azobisisobutylonitrile (AIBN) as polymerization initiator, conforming to the solution polymerization method. The mean degree of polymerization was adjusted by properly controlling the catalyst amount and solvent amount.

The following tests were conducted on the electrophotographic photosensitive materials prepared in the above examples and comparative examples.

EVALUATION TESTS

The surface potential measurement, exposure measurement, residual potential measurement, surface potential measurement after repeated exposure, and wear resistance test were conducted in the same methods as mentioned above on the electrophotographic photosensitive materials obtained in Examples 4 to 8 and Comparative Examples 4 to 7.

Measurement of Surface Potential Change After Exposure to Ozone

The electrophotographic photosensitive material was set in a copier (DC-152Z of Mita), and a negative corona discharge was generated by operating the main charger of the copier, and the vicinity of the photosensitive material surface was exposed to an ozone atmosphere of 7 ppm of concentration for 60 minutes. Afterwards, the surface potential of the electrophotographic photosensitive material was measured, and the difference from V s.p. was calculated as the ozone exposure potential variation $\Delta V0_3$ (V).

Appearance

The appearance of the surface protective layer was visually observed.

The results are shown in Table 2 as classified by the thermoplastic resins for the invention.

TABLE 2

| | Polyvinyl acetate | | Results of measurement | | | | | | | |
|---|---|---|---|---|---|---|---|---|---|---|
| | Mean degree of polymerization | Content (parts by weight) | $V_1$ s.p. (V) | $V_2$ s.p. (V) | $-\Delta V$ (V) | $-\Delta VO_3$ (V) | V r.p. (V) | $E\frac{1}{2}$ ($\mu J/cm^2$) | Wear (mm) | Appearance |
| Example 4 | 200 | 10 | 762 | 730 | −32 | −43 | 156 | 21.9 | 0.5 | No abnormality |
| Example 5 | 1000 | 10 | 743 | 708 | −35 | −47 | 153 | 22.1 | 0.5 | No abnormality |
| Example 6 | 2000 | 10 | 751 | 722 | −29 | −39 | 151 | 21.8 | 0.4 | No abnormality |
| Example 7 | 200 | 30 | 753 | 727 | −26 | −36 | 157 | 22.3 | 0.6 | No abnormality |
| Example 8 | 200 | 0.1 | 759 | 728 | −31 | −52 | 154 | 21.7 | 0.7 | No abnormality |
| Comparative Example 4 | 200 | 60 | 748 | 725 | −23 | −32 | 202 | 28.6 | 3.4 | No abnormality |
| Comparative Example 5 | 2500 | 10 | 752 | 727 | −25 | −42 | 238 | 32.5 | 1.7 | White turbidity |
| Comparative Example 6 | 200 | 50 | 738 | 714 | −24 | −34 | 159 | 23.7 | 0.8 | White turbidity |
| Comparative Example 7 | 200 | 0.05 | — | — | — | — | — | — | — | Crack |

As clear from the results in Table 2, in the combined systems using polyvinyl acetate, when the content of polyvinyl acetate in 100 parts by weight of solid content of thermoset silicone resin exceeded 30 parts by weight to reach 50 parts by weight (Comparative Example 6), the surface protective layer became white and turbid although the initial sensitivity, photosensitive characteristics, wear resistance were nearly same as those in Examples 4 to 8. When the content of polyvinyl acetate was further increased to 60 parts by weight (Comparative Example 4), adverse effects on photosensitive characteristics appeared, such as elevation of residual potential and half-life exposure, and the wear resistance was extremely worsened. On the other hand, when the content of polyvinyl acetate went below 0.1 part by weight to drop to 0.05 part by weight (Comparative Example 7), cracks were formed on the surface protective layer, and it was unusable as electrophotographic photosensitive material (black stripes appearing on the image). Therefore, photosensitive characteristics and other performances were not measured. When polyvinyl acetate with mean degree of polymerization of 2500 was used (Comparative Example 5), the residual potential and half-life exposure elevated, and wear resistance dropped, and white turbidity was observed on the surface protective layer. By contrast, the electrophotographic photosensitive materials of Examples 4 to 8 were found to be superior to Comparative Examples 4 to 7 in all respects including half-life exposure, photosensitive characteristics, wear resistance, appearance and gas barrier.

Thus, the electrophotographic photosensitive materials of the invention do not adversely affect the photosensitive characteristic of the electrophotographic photosensitive materials, and possess a surface layer excellent in wear resistance.

In particular, when the surface protective layer contains polyvinyl acetate with mean degree of polymerization of 2000 or less by 0.1 to 30 parts by weight per 100 parts by weight of solid content of thermoset silicone resin, it is much improved in the gas barrier property, brittleness to sliding friction and others, as compared with the performance of the thermoset resin alone, without adversely affecting the sensitivity characteristics and physical properties of electrophotographic photosensitive materials.

What is claimed is:

1. An electrophotographic photosensitive material comprising a photosensitive layer and a surface protective layer containing a thermoset silicone resin, said photosensitive layer and said surface protective layer being laminated in this order on a conductive substrate surface, wherein the silicone resin of the surface protective layer is hardened by a hardening catalyst mainly comprised of a compound of the general formula (I)

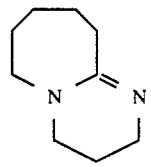

(I)

or an acid salt thereof which is selected from the group consisting of: a phenol salt, an octylic acid salt, a ptoluenesulfonic acid salt and a formic acid salt.

2. The electrophotographic photosensitive material of claim 1, wherein the surface protective layer contains polyvinyl acetate with a mean degree of polymerization of 2000 or less in an amount of 0.1 to 30 parts by weight per 100 parts by weight of solid content of the thermoset silicone resin.

3. An electrophotographic photosensitive material of claim 1, wherein the hardening catalyst is added by 0.1 to 20 wt. % of the solid content of the thermoset silicon resin.

4. An electrophotographic photosensitive material of claim 1, wherein the thermoset silicone resin is a hydrolysis product of organoalkoxy silane or organohalogen silane, or its initial condensation reaction product.

5. An electrophotographic photosensitive material of claim 4, wherein the thermoset silicone resin is a hydrolysis product of one or two or more types of compounds selected from a group of tetraalkoxy silane, trialkoxy silane, dialkoxy dialkyl silane, trichloralkyl silane and dichloralkyl silane, or its initial condensation reaction product.

6. The electrophotographic photosensitive material of claim 1, wherein the surface protective layer is 0.1 to 10 micrometers thick, whereby the surface protective layer does not adversely affect the sensitivity of the photosensitive layer.

7. The electrophotographic photosensitive material of claim 6, wherein the surface protective layer is 2 to 5 microns thick.

8. The electrophotographic photosensitive material of claim 1, wherein the photosensitive layer is of a single layer type.

9. The electrophotographic photosensitive material of claim 8, wherein the photosensitive layer is 10 to 50 microns thick.

10. The electrophotographic photosensitive material of claim 8, wherein the photosensitive layer is 15 to 25 microns thick.

11. The electrophotographic photosensitive material of claim 8, wherein the photosensitive layer includes an electric charge generating material and a charge conveying material in a binding resin.

12. The electrophotographic photosensitive material of claim 1, wherein the photosensitive layer is of a laminate type.

13. The electrophotographic photosensitive material of claim 12, wherein the photosensitive layer includes an electric charge generation layer containing an electric charge generating material in a binding resin and an electric charge conveying layer containing an electric charge conveying material in a binding resin.

14. The electrophotographic photosenstive material of claim 12, wherein the photosensitive layer includes an electric charge generating layer and an electric charge conveying layer.

15. The electrophotographic photosensitive material of claim 14, wherein the electric charge generating layer is made of a semiconductor material, and the electric charge conveying layer is made from an organic material.

* * * * *